US008137162B2

(12) United States Patent
Abrahamians et al.

(10) Patent No.: US 8,137,162 B2
(45) Date of Patent: Mar. 20, 2012

(54) SEMICONDUCTOR WAFER POLISHING MACHINE

(75) Inventors: Edmond Arzuman Abrahamians, Fremont, CA (US); Vladimir Volovich, Mountain View, CA (US)

(73) Assignee: Edmond Arzuman Abrahamians, Fremont, CA (US)

( * ) Notice: Subject to any disclaimer, the term of this patent is extended or adjusted under 35 U.S.C. 154(b) by 1015 days.

(21) Appl. No.: 12/075,973

(22) Filed: Mar. 14, 2008

(65) Prior Publication Data

US 2009/0029634 A1 Jan. 29, 2009

Related U.S. Application Data

(60) Provisional application No. 60/962,035, filed on Jul. 25, 2007.

(51) Int. Cl.
*B24B 5/02* (2006.01)

(52) U.S. Cl. ..... 451/274; 451/272; 451/288; 451/398; 451/392; 451/394

(58) Field of Classification Search ..... 451/272, 451/273, 274, 285, 286, 287, 288, 289, 290, 451/291, 392, 393, 394, 398, 400
See application file for complete search history.

(56) References Cited

U.S. PATENT DOCUMENTS

| | | | | |
|---|---|---|---|---|
| 3,708,921 | A | 1/1973 | Cronkhite et al. | |
| 4,194,324 | A | 3/1980 | Bonora et al. | |
| 4,918,870 | A | 4/1990 | Torbert et al. | |
| 5,205,082 | A | 4/1993 | Shendon et al. | |
| 5,562,524 | A | 10/1996 | Gill, Jr. | |
| 5,738,574 | A | 4/1998 | Tolles et al. | |
| 6,494,775 | B1 | 12/2002 | Abrahamians et al. | |
| 6,793,565 | B1 * | 9/2004 | Chadda et al. | 451/288 |
| 6,875,076 | B2 | 4/2005 | Abrahamians et al. | |
| 7,004,815 | B2 * | 2/2006 | Jeong | 451/8 |
| 7,241,203 | B1 * | 7/2007 | Chen et al. | 451/11 |

* cited by examiner

*Primary Examiner* — Timothy V Eley
(74) *Attorney, Agent, or Firm* — GSS Law Group

(57) ABSTRACT

Embodiments of the invention comprise a machine adapted for polishing work pieces such as large silicon wafers. A wafer polishing machine in accord with the invention comprises a rotatable platen in a table base, above which is mounted a lid having a head moving assembly with four synchronously rotatable head assemblies. A motor and linkage connected to the head moving assembly imparts reciprocating linear motion to the head assemblies in a selected direction in a plane parallel to an upper surface of the platen. Embodiments of the invention produce a complex relative motion between a surface of a wafer to be polished and the platen. The complex relative motion, resulting from a combination of motions including rotation of the platen, rotation of the head assemblies, and translation of the head moving assembly, improves a uniformity of polish and a rate of polishing compared to wafer polishing machines known in the art.

12 Claims, 4 Drawing Sheets

SEMICONDUCTOR WAFER POLISHING MACHINE

CROSS REFERENCE TO RELATED APPLICATIONS

This application claims the benefit of the priority date of provisional patent application Ser. No. 60/962,035, filed on Jul. 25, 2007, which is incorporated herein by reference in its entirety.

FIELD OF THE INVENTION

The present invention relates to semiconductor equipment and in particular to a machine for polishing semiconductor wafers.

BACKGROUND

Semiconductor integrated circuits are typically made from thin wafers cut from silicon ingots known as boules. Cutting a wafer from a boule generally leaves the surfaces of the wafer in a rough condition, so wafers are polished on wafer polishing machines prior to starting semiconductor processing operations. The difficulty in achieving desired values of flatness and surface roughness increases as the diameter of the wafer to be processed increases and as the size of semiconductor structures (also known as "feature size") to be fabricated on the wafer decreases. Wafer diameters have steadily been increasing and feature sizes decreasing at the same time that manufacturers have been pressured by market forces to increase manufacturing throughput and reduce manufacturing costs.

In the past, the relatively small size of wafers permitted a single wafer polishing machine having one or more head assemblies, each head assembly adapted to hold a plurality of wafers, to flatten and smooth many wafers simultaneously. Polishing machines use an abrasive, corrosive slurry to mechanically and chemically remove microscopic projections from the surface of a wafer. Machines for polishing bare wafers and machines for polishing by a chemical and mechanical process are known in the art. A wafer polishing machine has a horizontal rotating platen in a table base with a polishing pad attached to the top of the platen. A lid attached to the table base has at least one head assembly that is rotated during polishing. A wafer carrier attached to a head assembly holds one or more wafers to be polished. Pumps deliver slurry at a selected rate to the polishing pad and motors rotate the platen and head assemblies. Parts of the head assembly for carrying wafers have vertical travel relative to the surface of the polishing pad and may be raised or lowered to contact the polishing pad and to apply a selected amount of pressure to the surface of the wafers to be polished.

One or more wafers to be polished are attached to a wafer carrier and a wafer carrier is attached to each head assembly. Next, slurry is deposited on the polishing pad. The lid with wafers attached to the carriers on the head assemblies is lowered to enclose a polishing envelope and bring wafers closer to the polishing pad, and slurry is deposited on the polishing pad. Separate drive motors for the platen and head assemblies enables independent control of speed and direction of rotation. Polishing continues until the wafers achieve a desired value of wafer material removal, a desired value of surface quality, or a combination of both.

A quality and a rate of wafer polishing depend in part on a magnitude and direction of motion of the wafers relative to the polishing pad. The relative motion between the wafers and the polishing pad includes a component of rotational motion from the platen combined with a component of rotational motion of the head assembly to which the wafer is attached. In the case of a head assembly having a carrier holding a plurality of wafers, rotation of the head assembly results in wafer rotation relative to the platen and orbital motion of each wafer to and from the center axis of the platen. As technology progresses, the diameter of processed wafers also increases and the number of wafers that fit onto a carrier is correspondingly reduced. Furthermore, as wafer diameter increases, an edge of the wafer moves closer to the rotational center of a head assembly. The contribution to the rate of polishing by the rotation of the head assembly decreases for those parts of the wafer that are closest to the center of rotation of the head assembly. Some wafers are large enough that only one wafer may be placed in the central area of a carrier on a head assembly, in which case the component of radial, orbital motion from rotation of the head assembly is effectively lost in the central area of the wafer, and the quality of polishing is significantly degraded.

To achieve high quality polishing for large wafers, for example wafers having a diameter of 300 millimeters (12 inches), some polishing machines have only one head assembly above the platen. However, having only one head assembly per platen significantly reduces a rate of production compared to machines adapted to polish many wafers simultaneously. Adding more machines to make up the production rate difference per machine requires a higher capital investment in equipment and more factory floor space.

What is needed is a polishing machine having high throughput and a complex relative motion between a surface of a wafer to be polished and a polishing pad on a platen, for all parts of the surface of a large wafer.

SUMMARY

Embodiments of the present invention comprise a wafer polishing machine adapted for polishing large wafers efficiently and economically. In one embodiment, a wafer polishing machine in accord with the invention comprises a rotating platen and polishing pad in a table base, above which is mounted a lid having a head moving assembly with four rotating head assemblies. During operation, the head moving assembly collectively moves the head assemblies in reciprocating linear motion in a plane parallel to an upper surface of the platen while the platen and head assemblies are rotating. Embodiments of the invention produce a complex relative motion between a surface of a wafer to be polished and the polishing pad. The complex relative motion, resulting from a combination of motions including rotation of the platen, rotation of the head assemblies, and translation of the head moving assembly including four head assemblies, improves a quality and a throughput of polishing and prolongs a service life of the polishing pad compared to wafer polishing machines known in the art.

The above summary of the present invention is not intended to represent each disclosed embodiment, or every aspect, of the present invention. Other aspects and example embodiments are provided in the figures and the detailed description that follow.

BRIEF DESCRIPTION OF THE DRAWINGS

Embodiments of the present invention may be more completely understood in consideration of the following detailed description and accompanying drawings, in which.

DESCRIPTION

Figure 1:
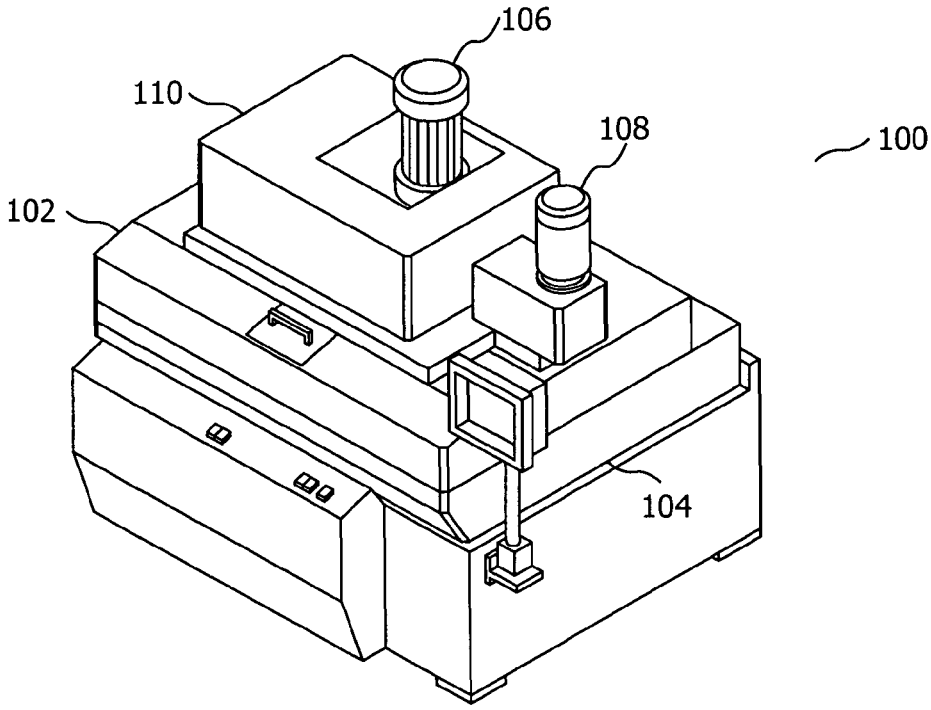
FIG. 1 is a simplified pictorial view of a wafer polishing machine in accord with an embodiment of the invention.
Figure 2:
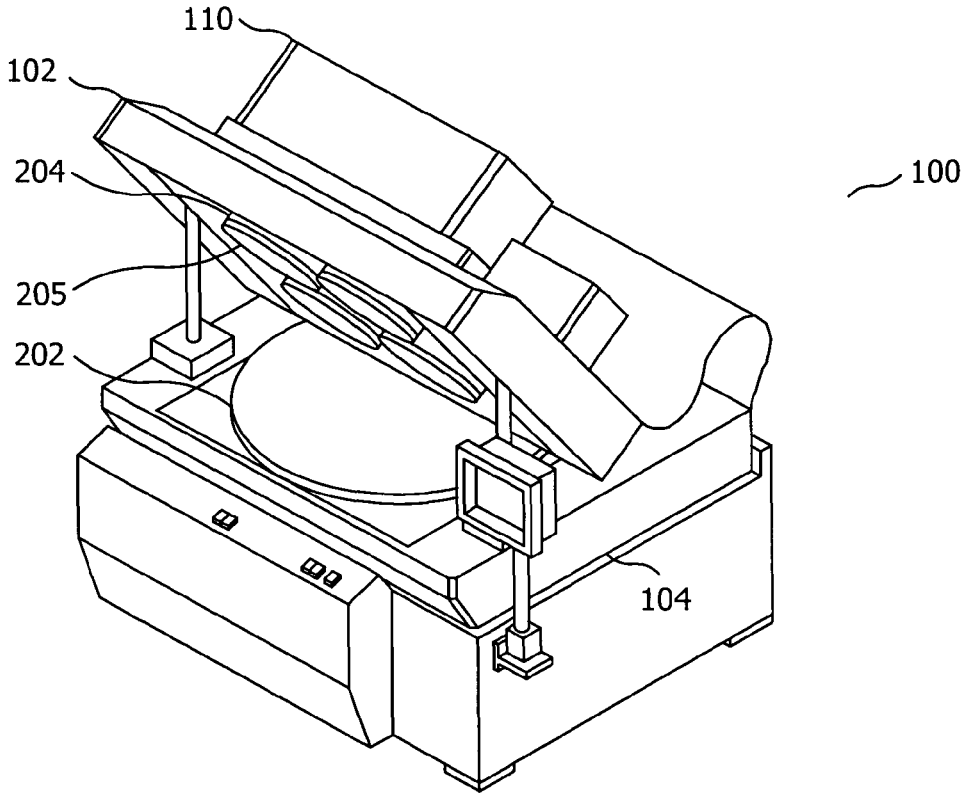
FIG. 2 is a pictorial view of the embodiment of FIG. 1, in which the lid is raised from the table base and the platen and head assemblies are visible.

A wafer polishing machine adapted for polishing large wafers in accord with an embodiment of the invention is shown in FIG. 1 and FIG. 2. The wafer polishing machine 100 comprises a table base 104 with a lid 102, shown closed in FIG. 1 and with the lid 102 raised in FIG. 2. Various electrical cables, slurry hoses, seals, switches, valves, and other support equipment have been omitted from the figures to facilitate a clearer view of the locations and functions of components discussed herein.

In FIG. 1, a top cover 110 encloses a head moving assembly (see FIG. 3 and FIG. 4) that partially protrudes through an opening formed in the lid 102. A head assembly drive motor 106 in FIG. 1 imparts rotation to four head assemblies 204 visible on the underside of the lid 102 in FIG. 2. The head assembly drive motor 106 and four head assemblies 204 are parts of the head moving assembly. A head moving assembly drive motor 108 attached to a fixed part of the lid 102 imparts a reciprocating linear motion to the head moving assembly. A round platen 202 is mounted into the table base 104 and rotates during polishing. A polishing pad (not shown) is placed on the upper surface of the platen 202 to facilitate polishing of a work piece. Work pieces like semiconductor wafers are placed on wafer carriers 205 and attached to the ends of the four head assemblies 204 visible in FIG. 2.

Figure 3:
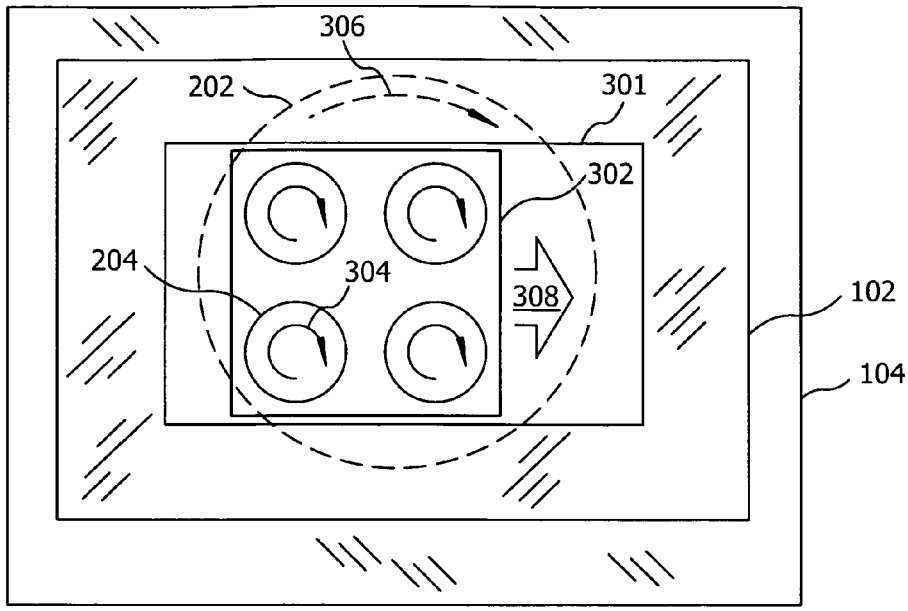
FIG. 3 is a simplified top view of an embodiment of the invention, showing a lid on top of a table base and a head moving assembly comprising four head assemblies in a square pattern sliding across the platen in an aperture formed in the lid.
Figure 4:
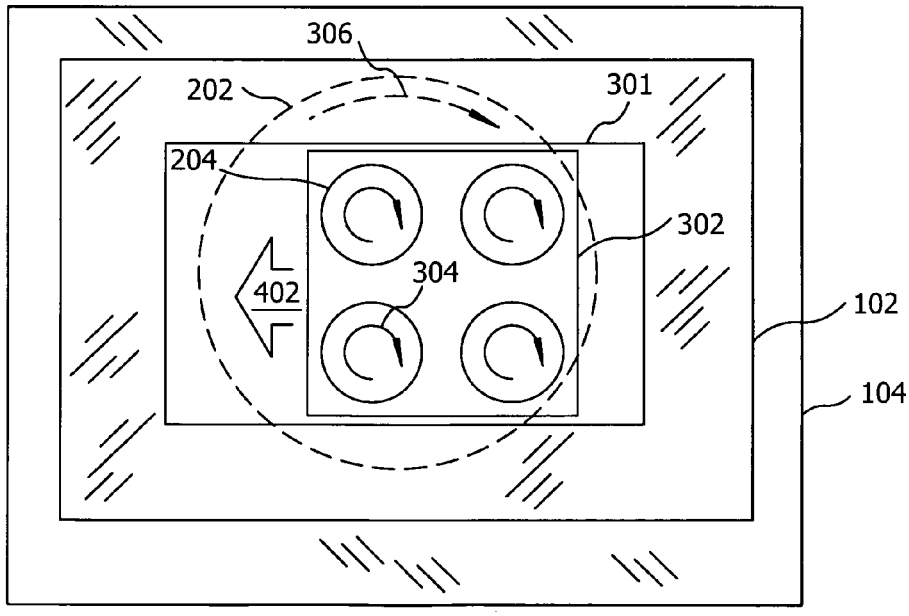
FIG. 4 is a simplified top view of the same embodiment as FIG. 3, showing the head moving assembly moving in a direction opposite to the direction shown in FIG. 3.

A simplified top view of an embodiment of the polishing machine 100 of FIG. 1 and FIG. 2 is shown in FIG. 3 and FIG. 4. In FIG. 3 and FIG. 4, the lid 102 is shown atop the table base 104. The platen 202, marked with a hidden line, is shown beneath the lid 102 in the table base 104. An example of a platen rotation direction 306 is marked with an arrow drawn with a dashed line. The platen 202 may optionally be rotated in a direction opposite to the platen rotation direction 306 shown. The platen may be rotated at a selected rate of rotation in the selected direction of rotation.

Figure 5:
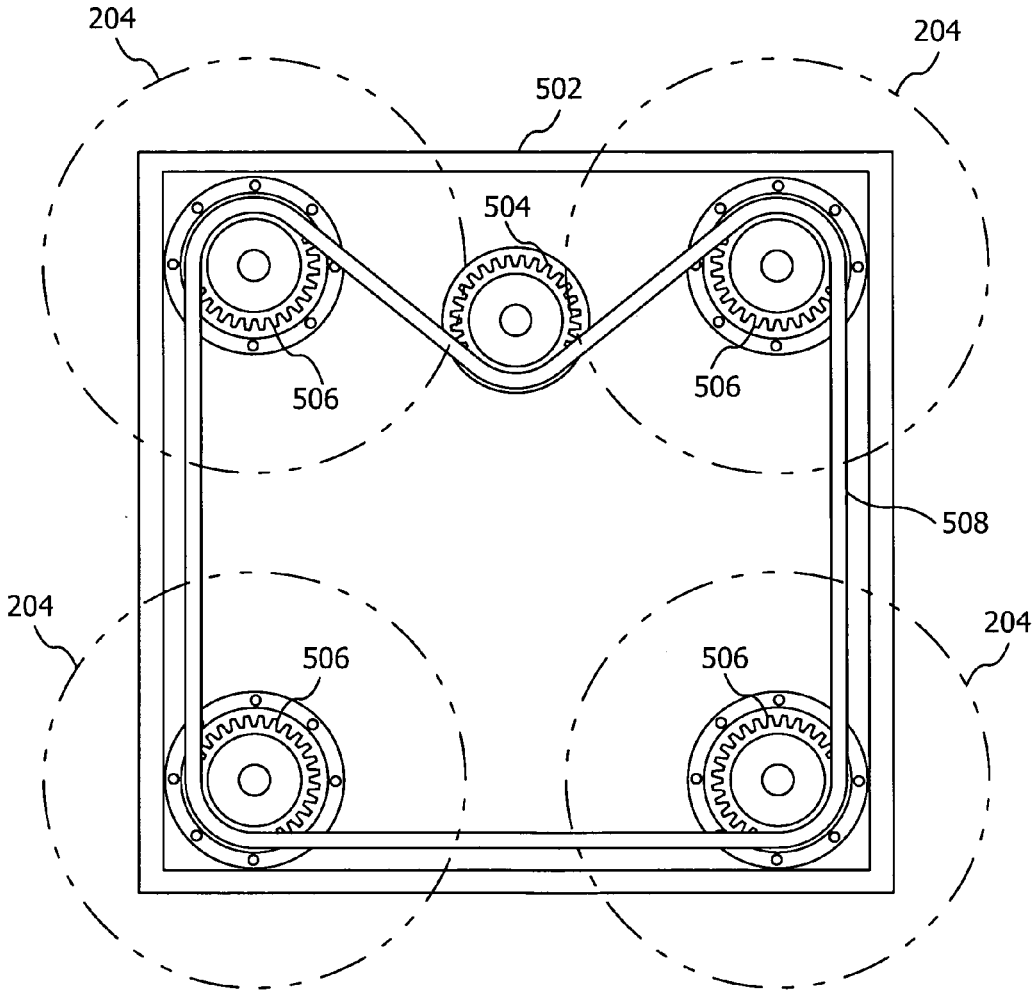
FIG. 5 is a simplified view of a drive box, a part of the head moving assembly used to cause the head assemblies to rotate together at a same rate of rotation.

The lid 102 is formed with a rectangular opening 301 in which a head moving assembly 302 slides back and forth above the platen 202. The head moving assembly 302 comprises four head assemblies 204. In some embodiments, the four head assemblies are attached to the head moving assembly in a square pattern, as shown in FIG. 3, FIG. 4, and FIG. 5. An example of a first head moving assembly translation direction 308 is shown in FIG. 3. An example of a second head moving assembly translation direction 402, representing a direction opposite to the direction shown in FIG. 3, is shown in FIG. 4. The head moving assembly 302 may be constrained to move on a linear path by slides, rails, channels, the sides of the aperture in the lid 102, or equivalent linear guiding means. Motion is imparted to the head moving assembly 302 by the head moving assembly drive motor 108 shown in FIG. 1. A mechanical linkage (not illustrated) connected to the head moving assembly drive motor 108 and to the head moving assembly 302 converts a continuously rotating output from the drive motor to a reciprocating linear motion of the head moving assembly. In some embodiments, the linkage converts the motor's rotary output to an approximately sinusoidal linear motion. Linkages for converting rotary to linear motion, for example rotary to sinusoidal linear motion, are well known in the art and will not be described further here. The head moving assembly may be moved at a selected rate of translation in each of the directions of translation.

An example of a head assembly direction of rotation 304 is shown by an arrow drawn with a solid line in FIG. 3 and FIG. 4. All four head assemblies 204 rotate in a same selected direction and at a same selected rate of rotation. In other embodiments, the head assembly direction of rotation 304 may be opposite to the direction shown in FIG. 3 and FIG. 4. A means of causing all four head assemblies 204 to rotate at a same rate and in a same direction is shown in FIG. 5. In FIG. 5, a drive box 502 comprises mechanical support and components for driving the four head assemblies 204. A drive motor pulley 504 is rotationally coupled to the head assembly drive motor 106 of FIG. 1, either by direct attachment to the motor drive shaft or by additional gears, belts, or pulleys. A head assembly pulley 506 is attached to a shaft for each head assembly 204. Rotating the head assembly pulley 506 causes the head assembly 204 connected to the pulley to rotate. A power coupling means 508 engages the drive motor pulley 504 and the head assembly pulleys 506 as shown in FIG. 5 such that a rotation of the drive motor pulley 504 causes a corresponding rotation of the head assembly pulleys 506 and correspondingly rotates the head assemblies 204. In some embodiments, the power coupling means 508 is a double-sided timing drive belt having teeth and in other embodiments it can be a drive chain.

In the embodiment of FIG. 3 and FIG. 4, the head moving assembly 302 is shown moving in a first translation direction 308 and a second translation direction 402. The first translation direction 308 and the second translation direction 402 are collinear and in opposite directions. A direction of translation of the head moving assembly 304 is selected such that a tangent to a circular rotation path that is concentric with the platen's center of rotation is at an angle of 45 degrees to the direction of translation when the head moving assembly is in a reference position. The reference position referred to herein is defined as a middle or nominal position of the head moving assembly 304. With the head moving assembly in the reference position, all four heads simultaneously have a tangent at 45 degrees to the direction of translation, as shown in FIG. 6.

Figure 6:
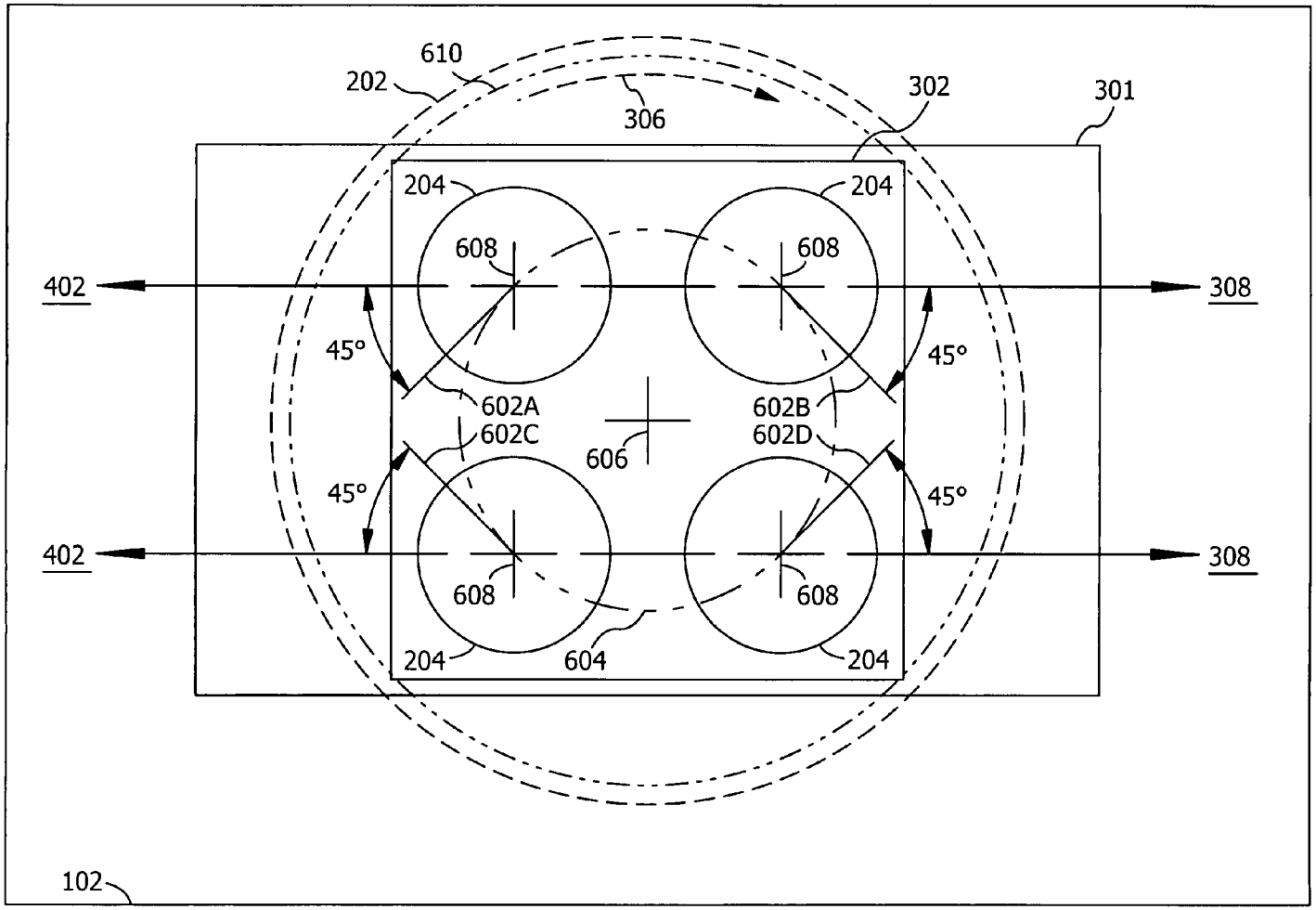
FIG. 6 is a top view of the embodiment of FIG. 3 showing a reference position and a reference angle for motion of the head moving assembly.

FIG. 6 shows a table base 102, a lid 102, and a head moving assembly 302 comprising four head assemblies 204, as in FIG. 3 and FIG. 4. A platen pad 610 on top of the platen 602 is represented by a phantom line. FIG. 6 further illustrates a reference position for the head moving assembly 302 and a direction of translation for the head moving assembly. A displacement of the head moving assembly 302 from the reference position illustrated in FIG. 6, also referred to as a middle position of the head moving assembly, corresponds to a magnitude of translation of the head moving assembly, a maximum value for which is determined by the size of the opening 301 in the lid 102. A platen circular rotation path 604, indicated with a phantom line, is shown concentric with the center of rotation 606 of the platen 202 and intersecting all four centers 608 of the head assemblies 204, thereby defining a reference position of the head assemblies and head moving assembly. Lines 602A, 602B, 602C, and 602D, each tangent to the platen circular rotation path 604 and each passing through a head assembly center or rotation 608, represent a direction of wafer center motion from platen 202 rotation relative to the platen 202. A direction of translation represented by a line 402 passing through the centers of rotation 608 of the head assemblies 204, or alternately an opposite direction of translation represented by lines 308, is selected such that a line representing the linear translation path for all four head assemblies is at an angle of 45 degrees to the rotational part of the wafer center motion relative to the platen. For example, tangent line 602A is one of four lines tangent to the platen circular rotation path 604. A translation direction is selected such that an angle of 45 degrees is formed between a line 402 representing the linear translation path of the head moving assembly 302 and the tangent line 602A. Similarly, 45 degree angles are formed between line pairs (402, 602C), (308, 602B), and (308, 602D). The 45 degree angle described herein is to be formed for all four heads simultaneously when the head moving assembly is in the reference position illustrated in FIG. 6.

Embodiments with four head assemblies in the head moving assembly have high throughput and provide high quality wafer polishing. Wafer polishing machines with one or two head assemblies process fewer wafers per unit time than embodiments of the invention. Wafer polishing machines with three head assemblies will not have the symmetries apparent from an examination of the four-head configuration of FIG. 3, FIG. 4, and FIG. 6, leading to differences in polishing rates compared to embodiments of the invention, and three head assemblies will not simultaneously meet the preferred 45 degree direction of translation described herein and in FIG. 6. Wafer polishing machines with more than four head assemblies in the head moving assembly will not simultaneously meet the preferred 45 degree direction of translation as defined in FIG. 6 and will not provide uniform optimal polishing conditions for the polishing process.

A method of polishing a plurality of wafers on a polishing machine in accord with an embodiment of the invention comprises mounting wafers to be polished to wafer carriers 205 and installing the wafer carriers 205 on the head assemblies 204 as shown in FIG. 2. The platen 202 with a polishing pad attached is rotated in a selected direction 306 as in FIG. 3 and FIG. 4. The head assemblies 204 with carriers 205 holding wafers are rotated at a selected rate and in a selected direction as in FIG. 3 and FIG. 4. The head moving assembly 302, also referred to as a drive box, is moved back and forth relative to the platen 202 within the opening 301 in a first translation direction 402 and a second translation direction 308. Slurry is supplied to the polishing pad, the carriers 205 are lowered until the wafers contact the rotating platen 202, and a separation distance between the wafers in the carriers 205 on the head assemblies 204 and the polishing pad on the platen 202 is adjusted to apply a selected amount of pressure between the wafers and the polishing pad. Pressure and motion continue until a selected quality of polish is achieved or until a selected amount of material is removed from the wafers. One skilled in the art will recognize that the steps above may optionally be performed in many different alternative sequences.

The present disclosure is to be taken as illustrative rather than as limiting the scope, nature, or spirit of the subject matter claimed below. Numerous modifications and variations will become apparent to those skilled in the art after studying the disclosure, including use of equivalent functional and/or structural substitutes for elements described herein, use of equivalent functional couplings for couplings described herein, or use of equivalent functional steps for steps described herein. Such insubstantial variations are to be considered within the scope of what is contemplated here. Moreover, if plural examples are given for specific means, or steps, and extrapolation between or beyond such given examples is obvious in view of the present disclosure, then the disclosure is to be deemed as effectively disclosing and thus covering at least such extrapolations.

Unless expressly stated otherwise herein, ordinary terms have their corresponding ordinary meanings within the respective contexts of their presentations, and ordinary terms of art have their corresponding regular meanings.

What is claimed is:

1. A machine for polishing a plurality of wafers, comprising:

a table base comprising a round platen adapted for rotation at a selected rate of platen rotation and in a selected direction of platen rotation; and a lid formed with a rectangular aperture, comprising:

a head moving assembly comprising four head assemblies rotatably attached in a square pattern to said head moving assembly, wherein each of said four head assemblies is adapted to hold at least one wafer and all of said four head assemblies rotate at a same head assembly rate of rotation and in a same head assembly direction of rotation;

a head assembly drive motor attached to said head moving assembly and rotationally coupled to said four head assemblies, wherein a rotation of said head assembly drive motor causes a corresponding rotation of said four head assemblies at said rate of head assembly rotation and said head assembly direction of rotation; and a head moving assembly drive motor attached to said lid and mechanically coupled to said head moving assembly, wherein said head moving assembly is slidably attached to said lid and said head moving assembly translates within said aperture formed in said lid in reciprocating linear motion in a plane parallel to an upper surface of said platen.

2. A machine for polishing a plurality of wafers, comprising:

a table base having a platen rotatably attached to said table base, wherein said platen has a flat upper surface adapted to hold a polishing pad; and a lid comprising:

a head moving assembly attached to said lid; and four head assemblies rotatably attached to said head moving assembly, wherein each of said four head assemblies is adapted to hold at least one wafer, said head moving assembly is adapted for reciprocating linear motion in a plane parallel to said flat upper surface of said platen, all of said four head assemblies are simultaneously movable in a same direction of linear motion by said head moving assembly, and during wafer polishing all wafers attached to said four head assemblies simultaneously contact said polishing pad on said platen.

3. The machine for polishing a plurality of wafers of claim 2, wherein said four head assemblies are adapted to rotate in a same direction.

4. The machine for polishing a plurality of wafers of claim 3, wherein said four head assemblies are adapted to rotate at a same rate of rotation.

5. The machine for polishing a plurality of wafers of claim 4, further comprising a drive box connected to said head moving assembly, said drive box further comprising:

four head assembly pulleys, one of each of said four head assembly pulleys attached to one of each of said four head assemblies;

a head assembly motor attached to said drive box;

a drive motor pulley attached to said head assembly motor; and a rotational coupling means coupled to said drive motor pulley and to all of said four head assembly pulleys, wherein a rotation of said drive motor pulley causes all of said four head assemblies to rotate in said same direction of rotation at said same rate of rotation.

6. The machine for polishing a plurality of wafers of claim 5, wherein said lid is formed with an aperture having a size adapted for clearance of said head moving assembly undergoing said reciprocating linear motion.

7. The machine for polishing a plurality of wafers of claim 6, further comprising a head moving assembly drive motor attached to said lid and to said head moving assembly, wherein said head moving assembly drive motor is adapted to translate said head moving assembly in said reciprocating linear motion.

8. The machine for polishing a plurality of wafers of claim 7, further comprising:

each of said four head assemblies further comprising a head assembly center of rotation;

a selected head moving assembly translation direction;

a platen circular rotation path, wherein said platen circular rotation path intersects said head assembly centers of rotation for each of said four head assemblies;

a platen center of rotation, wherein said platen circular rotation path is centered at said platen center of rotation; and four tangent lines, wherein one of each of said four tangent lines is tangent to said platen circular rotation path at one of each of said head assembly center of rotation, wherein an angle formed between said selected head moving assembly translation direction and each of said four tangent lines is 45 degrees.

9. A machine for polishing a plurality of wafers, comprising:

a table base having a platen rotatably attached to said table base, said platen having a flat upper surface adapted to hold a polishing pad; and a lid comprising:

a head moving assembly attached to said lid;

four head assemblies rotatably attached to said head moving assembly; and a drive box connected to said head moving assembly, said drive box further comprising:

four head assembly pulleys, one of each of said four head assembly pulleys attached to one of each of said four head assemblies;

a head assembly motor attached to said drive box;

a drive motor pulley attached to said head assembly motor; and a rotational coupling means coupled to said drive motor pulley and to all of said four head assembly pulleys, wherein each of said four head assemblies is adapted to hold at least one wafer, said head moving assembly is adapted for reciprocating linear motion in a plane parallel to said flat upper surface of said platen, and a rotation of said drive motor pulley causes all of said four head assemblies to rotate in a same direction of rotation at a same rate of rotation.

10. The machine for polishing a plurality of wafers of claim 9, wherein said lid is formed with an aperture having a size adapted for clearance of said head moving assembly undergoing said reciprocating linear motion.

11. The machine for polishing a plurality of wafers of claim 10, further comprising a head moving assembly drive motor attached to said lid and to said head moving assembly, wherein said head moving assembly drive motor is adapted to translate said head moving assembly in said reciprocating linear motion.

12. The machine for polishing a plurality of wafers of claim 11, further comprising:

each of said four head assemblies further comprising a head assembly center of rotation;

a selected head moving assembly translation direction;

a platen circular rotation path, wherein said platen circular rotation path intersects id head assembly center of rotation for each of said four head assemblies;

a platen center of rotation, wherein said platen circular rotation path is centered at said platen center of rotation; and four tangent lines, wherein one of each of said four tangent lines is tangent to said platen circular rotation path at one of each of said head assembly center of rotation, wherein an angle formed between said selected head moving assembly translation direction and each of said four tangent lines is 45 degrees.

* * * * *